United States Patent [19]

Rawdon et al.

[11] Patent Number: 4,756,360

[45] Date of Patent: Jul. 12, 1988

[54] FLUIDIZED BED HEAT EXCHANGER

[75] Inventors: Albert H. Rawdon, Shrewsbury; Gerald S. Gielda, Holden, both of Mass.

[73] Assignee: Riley Stoker Corporation, Worcester, Mass.

[21] Appl. No.: 30,148

[22] Filed: Mar. 25, 1987

[51] Int. Cl.[4] ..... F28D 13/00; F28D 19/02

[52] U.S. Cl. ..... 165/104.16; 122/4 D; 122/6 A; 110/245; 165/104.18

[58] Field of Search ..... 122/4 D, 6 A; 165/104.16, 104.18; 110/245

[56] References Cited

U.S. PATENT DOCUMENTS

| | | | |
|---|---|---|---|
| 3,893,426 | 7/1975 | Bryers | 122/4 D |
| 4,449,482 | 5/1984 | Leon et al. | 122/4 D |
| 4,633,818 | 1/1987 | Horlitz, Jr. et al. | 122/4 D |

*Primary Examiner*—Albert W. Davis, Jr.

*Attorney, Agent, or Firm*—Mason, Kolehmainen, Rathburn & Wyss

[57] ABSTRACT

A heat exchanger for use in a multi-solid fluidized bed heat generating system includes a housing for containing a flowing volume of hot gas and fluidized recirculating solid particulate material. The housing includes outer side walls, a top wall and an intermediate bottom structure comprising water wall panels for containing a flow of water/steam to be heated from the hot gas and solid material contained within the enclosure formed by the housing walls. A supply header is provided to direct water/steam to be heated into the water wall panels at a lower level and a takeoff header is utilized for removing the heated water/steam from the wall panels at an upper level. A fluidizing gas injector system is provided for directing a high velocity flow of gaseous fluid into the enclosure formed by the housing water wall panels at a lower level therein for fluidizing the recirculating solid particulate material, which material is recycled back into a combustion vessel of the fluidized bed heat generating system.

17 Claims, 5 Drawing Sheets

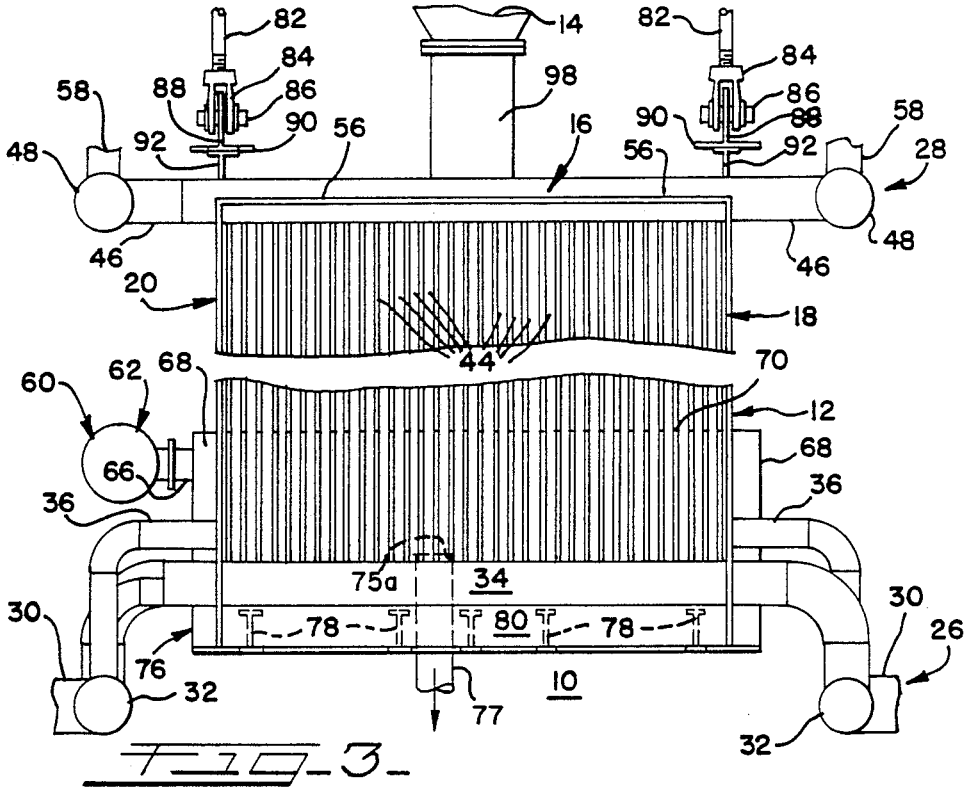
FIG. 3
FIG. 4
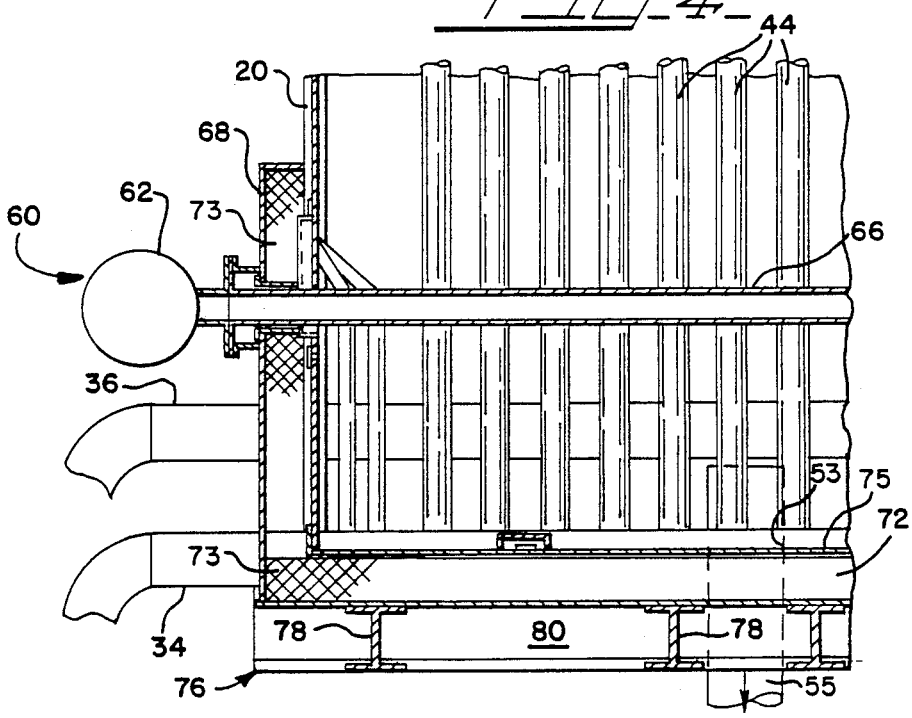

FLUIDIZED BED HEAT EXCHANGER

BACKGROUND OF THE INVENTION

1. Field of the Invention

The present invention relates to heat exchangers and more particularly to a heat exchanger especially adapted for use in a multi-solid, fluidized bed, heat generating system wherein hot fine solid particulate material is recirculated between the heat exchanger and a combustion reactor vessel. The heat exchanger of the present application comprises a modified form of heat exchanger which differs from the external heat exchanger that is disclosed in copending U.S. Pat. application Ser. No. 939,819, filed Dec. 9, 1986 now U.S. Pat. No. 4,709,663 granted Dec. 1, 1987 (Larson et al), which application is assigned to the same assignee as the present application.

2. Description of the Prior Art

Fluidized bed, multi-solid, heat generating systems such as those disclosed in U.S. Pat. Nos. 4,084,544 and 4,154,581, include a combustion vessel having a dense bed section containing relatively large size or coarse solid particulate material maintained in a fluidized state in a limited area within the vessel for pulverizing the fuel and retaining at least a portion of the pulverized material in the bed while mixing with oxygen for controlled combustion in and above the dense bed section. Fluidized solid fines or small size solid particulate material is recirculated between the combustion vessel and an external heat exchanger. These fines are adapted to absorb heat generated in the combustion process within the combustion vessel and thereafter give up the heat in the external heat exchanger to generat steam before the fines are recirculated back into and through the dense bed section of the combustion reactor vessel. A relatively high percentage of the heat energy developed in the combustion process is transferred in the external heat exchanger from the recirculating fine solid particulate material to the water/steam moving through heat exchange coils that are provided in the external heat exchanger body or enclosing structure.

The heat exchanger of the present invention is especially designed and adapted to provide a more efficient heat transfer between the recirculating fine solid particulate material and the feed water/steam which is to be heated by the energy developed in the combustion process and carried by the recirculating solid fine particulate material.

OBJECTS OF THE PRESENT INVENTION

Accordingly, it is an object of the present invention to provide a new and improved heat exchanger for use in a multi-solid, fluidized bed, heat generating system and more particularly, it is an object of the present invention to provide a new and improved heat exchanger which is especially well adapted to efficiently transfer heat from recirculating fine solid particulate materials to water/steam introduced into the heat exchanger at a lower level and extracted therefrom at an upper level.

It is an object of the present invention to provide a new and improved heat exchanger of the character described wherein water wall panels are provided so as to form a heat exchanger enclosure for containing a flow of hot gas and hot solid fine particulate material to be recycled back into the combustion vessel after heat is extracted therefrom.

Another object of the present invention is to provide a new and improved heat exchanger of the character described wherein an internal hot chamber is formed within a housing of the heat exchange enclosure for initially receiving hot gas and hot fine solid particulate material carried thereby.

Yet another object of the present invention is to provide a new and improved external heat exchanger of the character described wherein water wall panels are provided as vertical outer walls of the heat exchanger enclosure and wherein a water wall panel is also provided as a top wall thereof for extracting heat from a flowing volume of hot gas and hot particulate material contained in the enclosure.

Yet another object of the present invention is to provide a new and improved heat exchanger of the character described employing an intermediate bottom structure comprising a plurality of spaced apart horizontal water tubes which feed a plurality of upstanding spaced apart water tubes disposed within the interior of the enclosing walls of the heat exchanger.

Another object of the present invention is to provide a new and improved heat exchanger which employs a natural circulation of water/steam and thus does not require a circulation pump.

Another object of the present invention is to provide a new and improved heat exchanger having an enclosure formed by finned tube type, water wall panels so that the heat exchanger can be more compact and the need for a refractory box eliminated.

It is another object of the present invention to provide a new and improved external heat exchanger of the character described which can be operated at pressures of up to 2,600 psi.

Still another object of the present invention is to provide a new and improved external heat exchanger of the character described employing a novel fluidizing air/gas injector system that provides fluid inputs directly between vertical tubes forming the heat exchanger outer walls and which employs additional interior inputs to obtain maximum benefits from fluidization of the fine solid particulate material flowing in the recirculation system.

Another object of the present invention is to provide a new and improved external heat exchanger of the character described which is highly efficient in operation and which is suitable for use in a wide variety of heat exchange functions wherein heat is to be transferred between fluidized solid particulate materials and fluid such as water/steam moving through finned tube type water wall panels of a flow containing enclosure.

BRIEF SUMMARY OF THE PRESENT INVENTION

The foregoing and other objects and advantages of the present invention are accomplished in an illustrated embodiment comprising a new and improved heat exchanger which includes a housing for containing a flowing volume of hot gas and hot fluidized solid particulate material. The housing is formed with a plurality of outer water wall panels comprising finned tubes for containing a flow of water/steam to be heated from the hot gas and hot solid particulate material contained within the interior of the housing. A lower supply header is provided for supplying water/steam to be heated to flow naturally upwardly in the water wall panels from a lower level to reach a takeoff header at an upper level which is provided for removing the heated water/steam from the exchanger. An air/gaseous fluid injector system is provided for directing high velocity fluidizing gas into the interior of the housing at a lower level therein adjacent an intermediate, water tube, bottom structure, which structure also provides feed water to supply a plurality of internal upstanding water tubes in the enclosure. The gas injector system insures that the hot solid particulates are well fluidized to efficiently transfer heat to the water/steam moving through the water tubes and the water wall panels of the enclosure.

BRIEF DESCRIPTION OF THE DRAWING

For a better understanding of the present invention, reference should be had to the following detailed description taken in conjunction with the drawings, in which:

FIG. 3 is a transverse cross-sectional view of the heat exchanger taken substantially along lines 3—3 of FIG. 1;

FIG. 4 is a fragmentary transverse cross-sectional view taken substantially along line 4—4 of FIG. 2;

DESCRIPTION OF A PREFERRED EMBODIMENT

Figure 1:
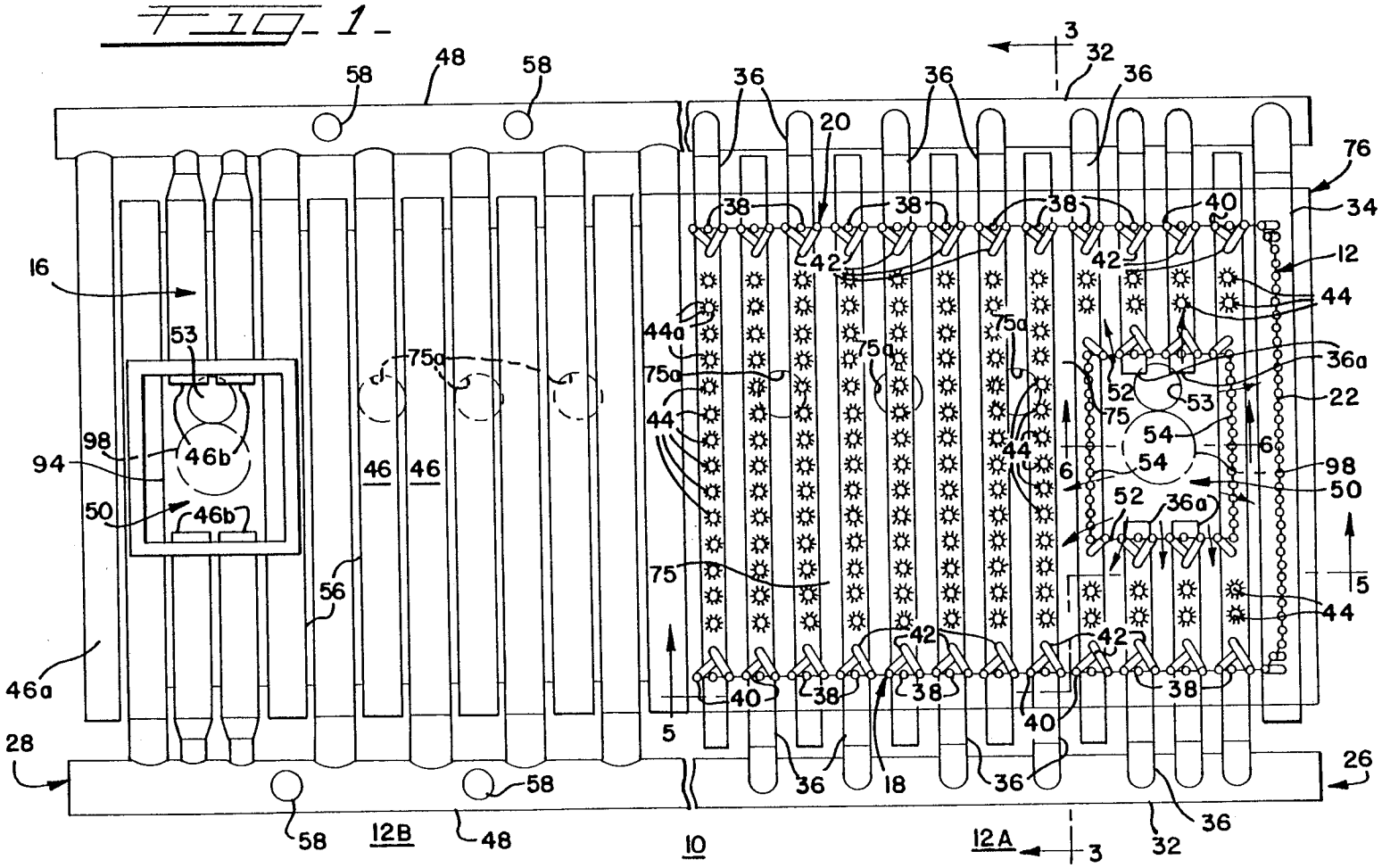
FIG. 1 is a top plan view of a new and improved heat exchanger in accordance with the features of the present invention with portions cut away and in section for clarity.

Referring now more particularly to the drawings, therein is illustrated a new and improved heat exchanger constructed in accordance with the features of the present invention and referred to generally by the reference numeral 10. The heat exchanger 10 includes a generally rectangular shaped enclosure or housing 12 for containing a flowing volume of hot gas and hot fluidized solid particulate material received from one or more mechanical separators such as cyclone type units 14 of an associated multi-solid fluidized bed heat generating system of the type described in the aforementioned copending U.S. Pat. application, Serial No. 939,819, filed Dec. 9, 1986, which application is incorporated herein by reference.

Figure 2:
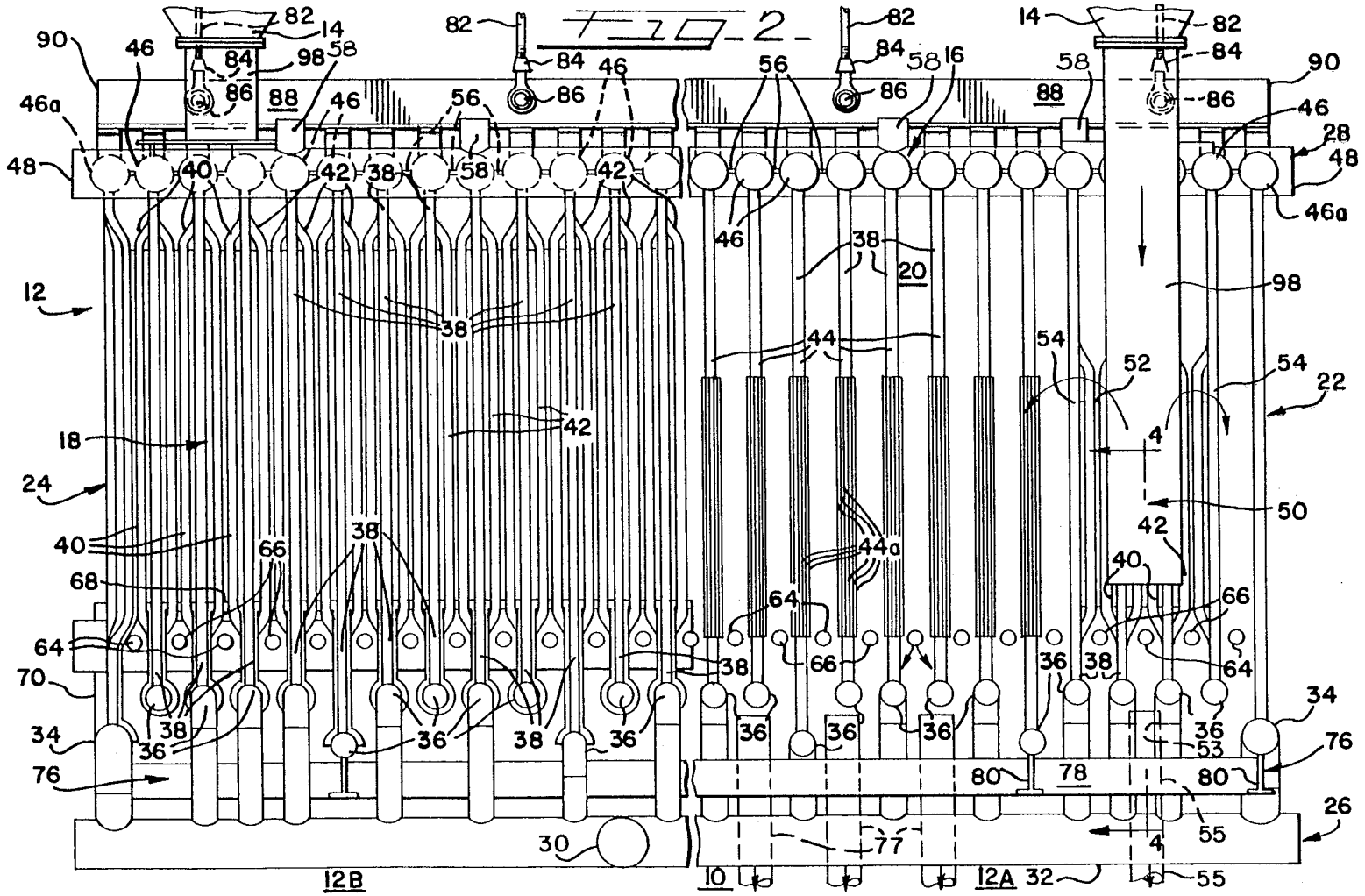
FIG. 2 is a side elevational view of the heat exchanger with portions cut away and in section.

When a pair of such cyclones 14 are utilized in a heat generating system, the housing 12 includes opposing half sections 12A and 12B, which halves are substantially identical in operation and construction, each half being utilized for handling the flowing volume of hot gas and recirculating fluidized solid particulate materials received from one cyclone separator unit 14. As illustrated in FIGS. 1, 2 and 3, preferably the cyclones are positioned to discharge downwardly into the housing 12 adjacent opposite end portions on a longitudinal centerline of the top of the rectangular housing.

In accordance with the present invention, the housing 12 includes a generally rectangular-shaped horizontally disposed top wall water panel 16, a pair of vertically disposed front and rear side water wall panels 18 and 20 which are interconnected at opposite ends by a pair of parallel, vertically disposed outer end, water wall panels 22 and 24. Fluid to be heated in the heat exchanger 10 comprising water and/or steam is supplied at a lower level to the water wall panels from a lower, supply header system 26 and after heat from the flowing volume of hot gas and hot solid particulate material within the housing 12 is picked up in the respective water wall panels 16, 18, 22 and 24, the heated water/steam is collected in an upper or takeoff header system indicated generally by the reference numeral 28.

As water/steam moves from the lower supply header 26 through the water wall panels and water tubes of the heat exchanger housing 12, a large quantity of heat is picked up from the hot gas and hot solid particulate materials contained within the housing and this heat is effectively and efficiently collected in the fluid reaching the upper or takeoff header system 28.

The lower supply header 26 includes a pair of intakes 30 provided at mid-length to direct water/steam into a pair of elongated supply headers 32 aligned in parallel spaced outwardly and below the rectangular enclosure or housing 12 of the heat exchanger. Referring to FIG. 1, each of the longitudinal headers 32 is connected to one of a pair of transversely extending end headers 34 and these end headers provide a supply of water/steam to the upstanding end water wall panels 22 and 24. Each longitudinal header 32 also provides a supply of water/steam to the front and back side water wall panels 18 and 20 through a plurality of inside transversely extending headers 36. As best shown in FIG. 1 the inside transverse headers 36 are fed from alternate sides from the respective opposite longitudinal headers 32 and are spaced apart from one another in a direction longitudinally of the enclosure 12 to provide a grid-like internal bottom structure at an elevation above the outside longitudinal headers 32.

Each inside transverse bottom header 36 supplies water/steam to upstanding or vertically extending water tubes 38 which are coaxially centered with respect thereto. As best shown in FIGS. 1 and 2, each inside transverse bottom header 36 also provides a supply of feed water/steam for a pair of vertical tubes 40 and 42 disposed on opposite sides of each centrally or coaxial aligned vertical tube 38. Thus each inside transverse header 36 supplies water/steam to the lower end of a set of tubes 38, 40 and 42 on each side of the enclosure 12. The front and back side wall panels 18 and 20 are formed by a plurality of sets of tubes 38, 40 and 42, and in each set the individual tubes are separated from one another by fin members therebetween. In addition to the outside walls 18 and 20, each transverse bottom header 36 supplies water/steam to the lower end of an array of a plurality of interior vertically disposed spaced apart tubes 44, each tube having a plurality of radial fins **44*a* extending longitudinally of the tubes from a lower level to a mid level as shown best in FIG. 2**.

Adjacent each end wall 22 and 24 of the enclosure 12 and coaxially centered below the respective cyclones 14, the heat exchanger is provided with an interior hot chamber or hot compartment 50 for receiving a flowing volume of hot gas and hot solid fine particulate material from the cyclone separator. The hot compartments 50 are formed by pairs of upstanding, parallel interior water wall panels 52 and 54 forming a rectangular, horizontal cross-section as best shown in FIG. 1. The water wall panels 52 are formed with sets of vertical water tubes 38, 40 and 42 like the outer side walls 18 and 20 and the walls 54 are formed by finned tubes similar to the water wall panel construction of the end walls 22 and 24. As illustrated in FIG. 1, each hot compartment side wall 52 is supplied with water/steam from a pair of short transverse headers 36*a* and the side walls of the hot compartment 54 are supplied from regular full length headers 36 coaxially aligned therewith.

As illustrated in FIG. 2, the fins between the vertical water tubes of the panels 52 and 54 of the hot chamber 50 are terminated at an upper level spaced intermediately between the headers 36 and the upper takeoff header 28 so that hot gas and hot solid fine material may flow over the upper ends of the fins between the tubes and spill out into the main interior portion of the enclosure 12 for movement around the tubes 44 and fins 44*a* thereof in heat exchanging relation therewith. Some of the hot solid fine particulate material that does not spill out into the main or surrounding (cold) compartment of the housing or enclosure 12 around the hot compartment 50 passes directly downwardly and out though a discharge opening 53 formed in the bottom of the hot chamber in a bottom wall 75 of the housing 12. This material passes through the discharge opening into a hot fines recycle duct 55 for direct recycling back to the combustion reactor vessel associated with the heat exchanger 10.

In accordance with the present invention, heated water/steam from the vertical water tubes 38, 40 and 42 of the water wall panels 18, 20, 22, 24, and the interior tubes 44 and water tubes 38, 40 and 42 of the hot compartment, side wall panels 52 and 54 is collected at the upper ends of the tubes by a plurality of transversely extending, upper horizontal headers 46 which in turn are connected alternately to a pair of longitudinally extending, upper takeoff headers 48 disposed outwardly of the enclosure 12 on opposite sides of the enclosure 12 and spaced parallel and above the lower supply headers 32. A pair of transverse headers 46*a* at opposite ends of the enclosure 12 are aligned to collect the water/steam from the end water wall panels 22 and 24. The upper transverse headers 46 and 46*a* are separated by fins 56, thus providing a continuous enclosure forming the top or upper horizontal water wall panel 16 of the enclosure 12.

As illustrated in FIG. 1, adjacent the hot compartment 50 several upper headers 46*b* are terminated shortly to form closed ends just inside of the compartment walls 52 similar to the short, lower transverse headers 36*a* directly therebelow. Heated water/steam collected in the longitudinally extending headers 48 of the takeoff header system 26 is delivered to the associated system components through a plurality of upstanding outlet conduits 58 spaced apart along the length of the headers.

In accordance with the present invention, in order to maintain the hot solid fine material within the enclosure 12 in a highly fluidized state to provide an efficient transfer of heat to the water/steam flowing through the water wall panels and the internal tubes, the heat exchanger 10 is provided with an air/gas fluid injector system 60 (FIGS. 3 and 4) which includes one or more elongated air plenums 62 generally parallel of and between the upper and lower headers 32 and 48, spaced upwardly above the inside transverse headers 36 forming the lower bottom structure. The elongated air plenum 62 is adapted to inject air at high velocity into the interior of the heat exchanger enclosure 12 from a plurality of circularly shaped wall injector ports 64 formed in the front and back water wall panels 18 and 20 between adjacent upstanding water wall tubes 38.

As illustrated, only a single elongated air plenum 62 may be required and in this case, additional fluidizing air may be injected into the interior of the housing 12 through a plurality of air injector tubes 66 extending transversely from and through the front side water wall panel 18 and terminating just short of the opposite or back side water wall panel 20 interiorly of the enclosure. Dependent upon the operating temperature of the external heat exchanger 10, the enclosure 12 may be provided with outer insulating side cover panels 68, end cover panels 70 and bottom cover panels 72 spaced below the headers 36 just underneath a bottom wall 75 of the chamber. Each of the panels is provided an interior body of heat insulating material 73 in order to minimize radiant heat loss from the lower portion of the outer surface of the finned tube type outer wall panels 18, 20, 22 and 24. The bottom panels 72 are provided with large size discharge openings at appropriate locations thereon aligned below discharge openings 75*a* formed in the housing bottom wall 75 below the headers 36. A plurality of cold recycle discharge ducts 77 are connected to the bottom panel 72 aligned with the discharge openings 75*a* in the bottom wall and these cold-fine recycle ducls are designed to recirculate the somewhat cooled solid fine particulate material back into the combustion reactor vessel associated with the external heat exchanger 10.

Figure 5:
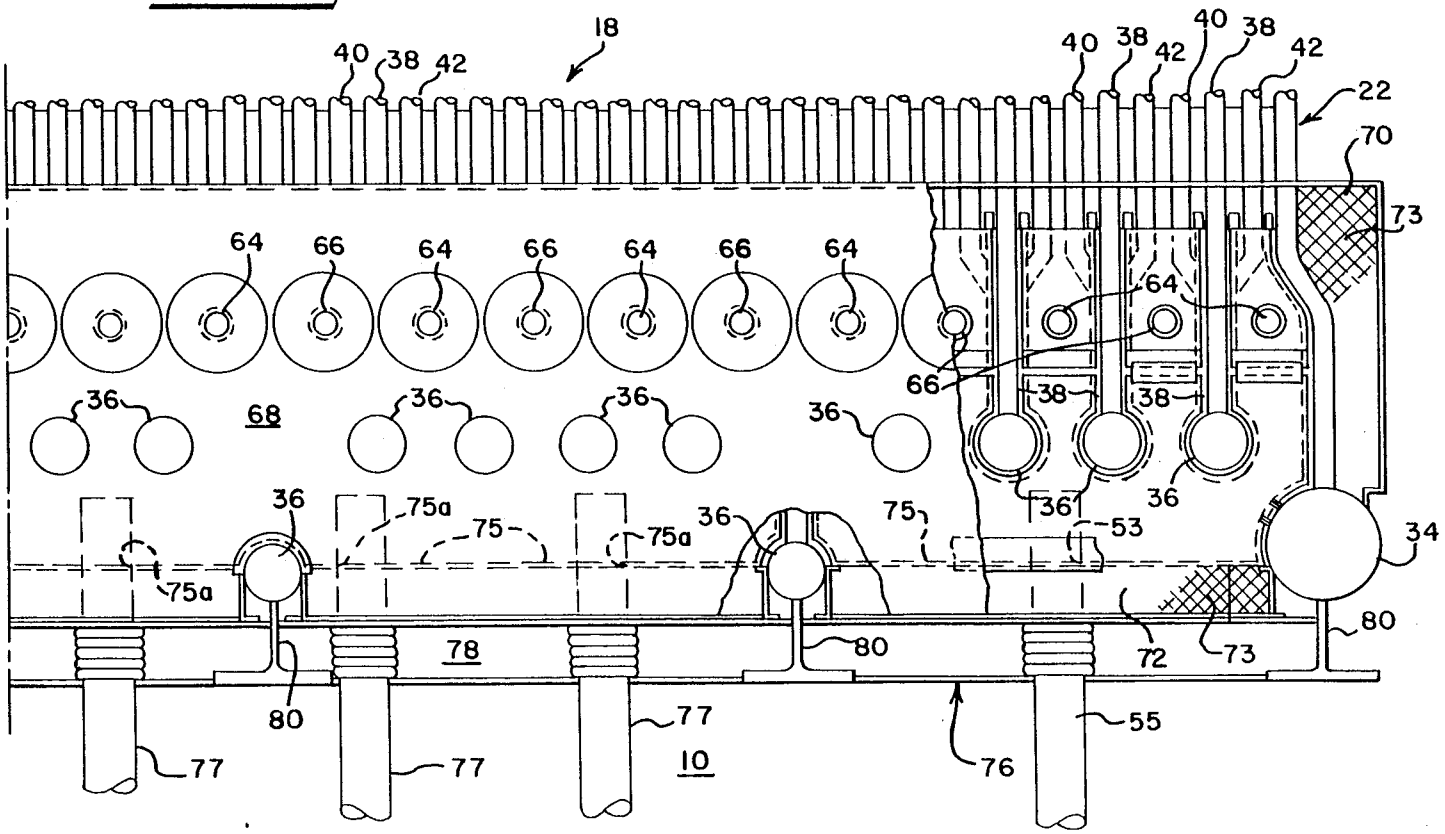
FIG. 5 is a fragmentary elevational view of the heat exchanger with portions cut away and in section for clarity taken substantially along lines 5—5 of FIG. 1.

As illustrated in FIGS. 3, 4 and 5, the lower header supply header 26 and a lower portion of the heat exchanger housing 12 is supported by a rectangular frame structure 76 including a rectangular grid formed by longitudinally extending structural beams 78 and transverse crossbeams 80. The heat exchanger 10 may be supported by the lower frame structure 76 alone or in the alternative may be additionally or completely supported by a plurality of vertical hanger rods 82, each rod having a clevis 84 and clevis pin 86 at the lower end, with the pins extending through an upstanding web portion 88 of an elongated T-beam 90. At longitudinally spaced intervals along each of the parallel T-beams 90, hanger brackets 92 are provided for supporting attachment to the upper takeoff header structure 28 and particular transverse headers 46 thereof.

Figure 6:
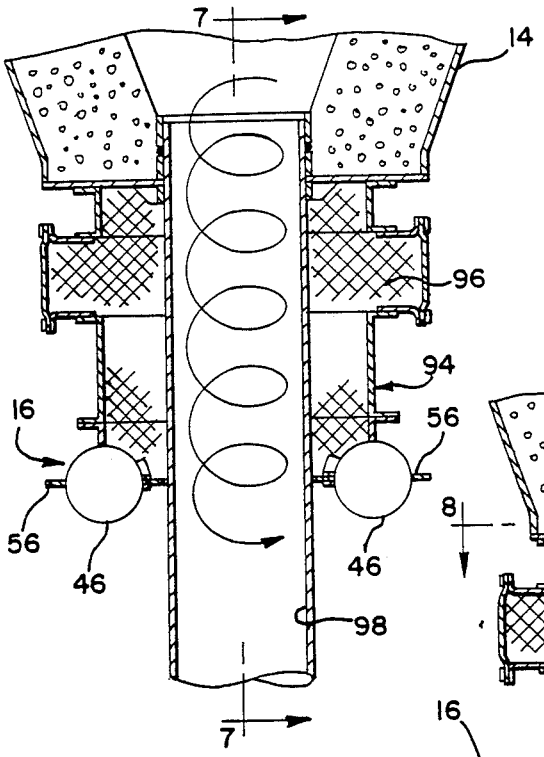
FIG. 6 is an enlarged fragmentary cross-sectional view of a feed input section of the heat exchanger taken substantially along lines 6—6 of FIG. 1.
Figure 7:
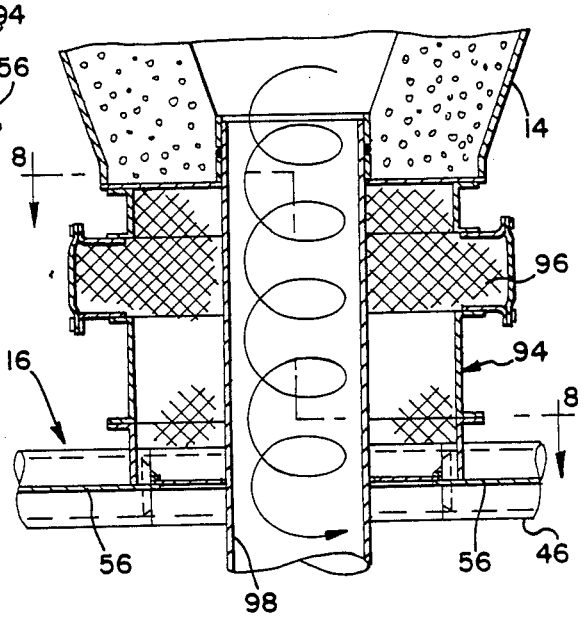
FIG. 7 is a fragmentary cross-sectional view taken substantially along lines 7—7 of FIG. 6.
Figure 8:
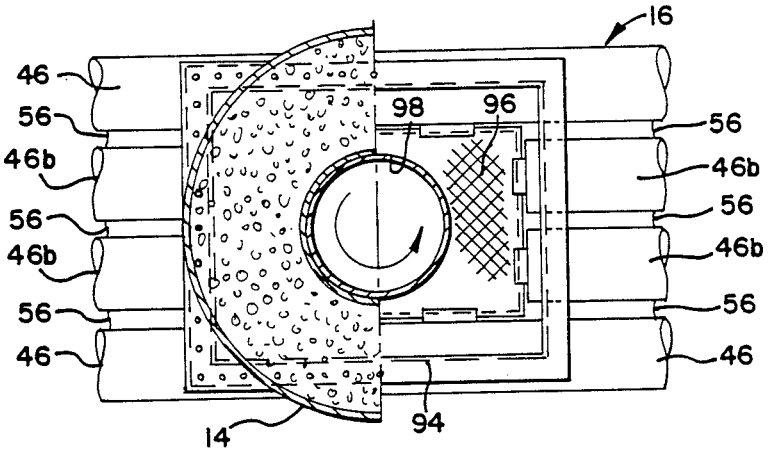
FIG. 8 is a fragmentary plan view with portions in section and cut away taken substantially along lines 8—8 of FIG. 7.

Referring now specifically to FIGS. 6, 7 and 8, the cyclone-type separator 14 disposed directly above each of the hot compartments 50 in the enclosure 12 is interconnected to discharge a flowing volume of hot gas and hot fine solid particulate material for supplying heat to the water/steam moving through the internal water tubes 44, headers 34, 36, 46 and 46*a* and the tubes of the several water wall panels forming the outer walls of the enclosure 12. For this purpose, a generally rectangular shaped, box-like housing 94 containing heat insulating material 96 is mounted in coaxial alignment above the vertical center axis of each hot chamber 50. A drop tube 98 is extended downwardly from the lower discharge end of each cyclone separator to direct downwardly flowing hot gas and hot particulate fine solid material into a lower portion of the hot compartment 50 just above the level of air injection from the injector ports 64 and injector tubes 66 as best shown in FIG. 2. The high velocity air/gas injected into the hot compartments 50 elutriates and carries the lighter fine solid particulate material upwardly around the drop tube to eventually spill out over the upper edges of the hot compartment walls 52 and 54 into the main body or interior of the enclosure 12.

Excellent heat transfer characteristics are provided by the heat exchanger 10 which employs large surfaces of finned tube type, water wall panels forming the exterior walls 18, 20, 22, 24 of the enclosure 12. Moreover, an array of vertical interior tubes 44 with radial fins **44*a* thereon and interior water wall panels 52 and 54 of the hot compartments 50 further aid in efficient heat transfer from the hot solid fines to the water/steam. A floor or intermediate level grid or bottom structure of the external heat exchanger is formed by the parallel, spaced apart tranverse headers 34 and 36, and these headers also pick up heat for the water/steam that is fed into the headers from the alternate longitudinal side headers 32 of the lower supply header system 26. Each of the headers 36 also feeds a row of vertical interior tubes 44 in the internal tube array disposed over substantially the entire cross-sectional area of the interior of the enclosure 12 and each row of interior tubes is in communication at the upper end with a transverse collection header 46 of the upper takeoff header system 28. These top panel headers 46 in combination with the fins 56 therebetween form en enclosing roof or top panel 16 for the enclosure 12 as a whole. Fluidizing air/gas pipes 66 and wall ports 64 which penetrate the front and back walls 18 and 20 are spaced between adjacent central water tubes 38 of each set of tubes 38, 40 and 42 extending upwardly from the bottom structure headers 36 on the outer water wall panels 18 and 20**.

The external heat exchanger 10 provides numerous advantages over other types of heat exchangers, and one major advantage is a natural water/steam circulating pattern through the system which does not demand or require a water/steam pump. By using finned tube type water wall panels for the enclosure walls over an extended surface, the overall size of the heat exchanger 12 can be made more compact than a conventional external heat exchanger of the same heat transfer capacity not employing outer water wall panels. The need for a refractory box is also eliminated because the side and end walls, and the top wall along with the intermediate bottom structure are fluid cooled by the water/steam flowing through the interior of the tubes. The external heat exchanger 10 can be operated at pressures of up to 2600 psi and the unique air/gas fluidizing system 60 is especially designed so that the injector wall outlets 64 and tubes 66 are spaced between the vertical water tubes 38 of the front and back side wall water panels 18 and 20.

Although the present invention has been described in terms of a preferred embodiment, it is intended to include those equivalent structures, some of which may be apparent upon reading this description, and others that may be obvious after study and review.

What is claimed and sought to be secured by Letters Patent of the United States is:

1. A heat exchanger, comprising:

a housing for containing a flowing volume of hot gas and fluidized solid particulate material, said housing including a plurality of outer water wall panels mounted in upstanding, generally parallel alignment, each of said water wall panels adapted for containing a flow of fluid to be heated from said hot gas and solid material contained within said housing;

supply header means for supplying fluid to be heated to said water wall panels at a lower level;

take-off header means for removing heated fluid from said water wall panels at an upper level; each of said outer water wall panels including a plurality of water tubes interconnected between said supply and said take-off header means and having fins between adjacent water tubes forming said outer wall of said housing;

a top water wall panel including a plurality of parallel water tubes and fins between adjacent water tubes forming a top outer wall of said housing extending between said plurality of said outer upstanding water wall panels;

an intermediate bottom structure in said housing comprising a plurality of parallel spaced apart water tubes extending between said plurality of said outer upstanding water wall panels;

inlet means on said top outer wall for supplying a flow of hot gas and solid particulate material to the interior of said housing;

a hot chamber in said housing below said inlet means for receiving said hot gas and solid particulate material, said chamber including an upstanding peripheral wall extending upwardly of said intermediate bottom structure and having an upper edge spaced below said top outer wall forming a dam over which said hot gas and solid particulate material received from said inlet means spills into the interior of said housing between said outer upstanding water wall panels; and gaseous fluid injector means for directing a high velocity flow of gaseous fluid into said housing at a lower level for fluidizing said solid particulate material therein.

2. The heat exchanger of claim 1, including;

a plurality of spaced apart, upstanding intermediate water tubes in said housing mounted between said outer upstanding water wall panels and interconnected between said water tubes of said top outer wall and said intermediate bottom structure at upper and lower ends thereof.

3. The heat exchanger of claim 2, wherein;

at least one of said upstanding intermediate water tubes is provided with one or more longitudinally extending, radially outwardly projecting fins, having a longitudinal outer edge spaced apart from an adjacent upstanding intermediate water tube.

4. The heat exchanger of claim 1, wherein;

said gaseous fluid injector means includes a plurality of gas injector inlets formed on at least one of said upstanding outer water wall panels between said water tubes therein for directing a flow of said gaseous fluid into said housing for fluidizing said solid particulate material.

5. The heat exchanger of claim 4, wherein;

said gas injector inlets are positioned at level spaced above said intermediate bottom structure.

6. The heat exchanger of claim 1, wherein;

said gaseous fluid injector means includes at least one gas injector inlet in said hot chamber for directing a flow of said gaseous fluid to fluidize said hot solid particulate material in said chamber.

7. The heat exchanger of claim 6, wherein;

said gas injector inlet in said hot chamber is positioned in said peripheral wall at a level above said intermediate bottom structure.

8. The heat exchanger of claim 7, wherein;

said peripheral wall of said hot chamber includes at least one upstanding water wall panel having a plurality of spaced apart water tubes and a fin between adjacent water tubes.

9. The heat exchanger of claim 1, wherein;

said supply header means includes a plurality of spaced apart water tubes extending between and in fluid communication with lower ends of said water tubes of said upstanding outer water wall panels.

10. The heat exchanger of claim 1, wherein;

said take-off header means includes a plurality of spaced apart water tubes extending between and in fluid communication with upper ends of said water tubes of said upstanding outer water wall panels.

11. The heat exchanger of claim 1; wherein;

said housing is generally rectangular in shape and includes pairs of said upstanding outer wall panels in spaced apart relation with one pair of said outer wall panels positioned generally normal to a second pair of said outer water wall panels to form a rectangular enclosure, said top water wall panel forming a top wall of said enclosure extending between said pairs of said outer water wall panels and having a plurality of transverse water tubes spaced apart by fins and interconnected to upstanding water tubes in one pair of said outer water wall panels, and said take-off header means interconnected to received heated fluid from said water tubes of said top water wall panel.

12. The heat exchanger of claim 11, wherein;

said supply header means is connected to supply fluid to said water tubes of said intermediate bottom structure outwardly of said one pair of said upstanding outer water wall panels.

13. The heat exchanger of claim 12, wherein;

said fluid injector means includes a plurality of fluid inlet ports in at least one pair of said upstanding outer wall panels between water tubes thereof.

14. The heat exchanger of claim 13, wherein;

said inlet ports are positioned at a level above said intermediate bottom structure.

15. The heat exchanger of claim 1, wherein;

said gaseous fluid injector means includes at least one gas injector inlet in said hot chamber for directing a flow of said gaseous fluid to fluidize said hot solid particulate material in said chamber.

16. The heat exchanger of claim 15, wherein;

said gas injector inlet in said hot chamber is positioned in said peripheral wall at a level above said intermediate bottom structure.

17. The heat exchanger of claim 16, wherein;

said peripheral wall of said hot chamber includes at least one upstanding water wall panel having a plurality of spaced apart water tubes and a fin between adjacent water tubes.

* * * * *